US009149099B2

(12) United States Patent
Nolan

(10) Patent No.: US 9,149,099 B2
(45) Date of Patent: Oct. 6, 2015

(54) PORTABLE STORAGE ENCLOSURE WITH SLIDING DOORS

(75) Inventor: Charles Francis Nolan, Keene, NH (US)

(73) Assignee: DRC Recreational Supplies LLC, Stoddard, NH (US)

( * ) Notice: Subject to any disclaimer, the term of this patent is extended or adjusted under 35 U.S.C. 154(b) by 269 days.

(21) Appl. No.: 13/401,305

(22) Filed: Feb. 21, 2012

(65) Prior Publication Data

US 2012/0255955 A1 Oct. 11, 2012

Related U.S. Application Data

(60) Provisional application No. 61/473,028, filed on Apr. 7, 2011.

(51) Int. Cl.

| | |
|---|---|
| ***B65D 19/02*** | (2006.01) |
| ***B65D 43/12*** | (2006.01) |
| ***B65D 6/00*** | (2006.01) |
| ***A45C 5/04*** | (2006.01) |

(52) U.S. Cl.

CPC ..... *A45C 5/04* (2013.01); *Y10T 29/49826* (2015.01)

(58) Field of Classification Search

CPC ..... B65D 9/32; B65D 9/34; B65D 9/22; B65D 9/06; B65D 25/04; B65D 43/02; B65D 43/12; B65D 43/20

USPC ..... 220/345.5, 345.4, 4.28, 771; 217/12 R, 217/62, 59, 40, 43 R; 229/125.12, 199.1

See application file for complete search history.

(56) References Cited

U.S. PATENT DOCUMENTS

| | | | | |
|---|---|---|---|---|
| 242,319 | A * | 5/1881 | Creswell | 217/62 |
| 1,558,771 | A * | 10/1925 | Anderson | 217/22 |
| 2,276,635 | A * | 3/1942 | Weber | 220/349 |
| 2,339,694 | A * | 1/1944 | Gersten | 312/295 |
| 3,736,035 | A | 5/1973 | Brown et al. | |
| 4,009,796 | A | 3/1977 | Schmidt | |
| 4,221,302 | A | 9/1980 | Kupersmit | |
| 4,561,554 | A * | 12/1985 | Swincicki | 220/4.28 |
| 4,597,122 | A * | 7/1986 | Handler et al. | 5/503.1 |
| 4,757,913 | A * | 7/1988 | Yerman | 220/345.5 |
| 4,809,851 | A | 3/1989 | Oestreich, Jr. et al. | |
| 5,584,430 | A * | 12/1996 | Mulry | 229/117.16 |
| 8,028,849 | B2 | 10/2011 | Hall | |
| 8,448,997 | B2 * | 5/2013 | Laliberte et al. | 292/92 |
| 2002/0053166 | A1 * | 5/2002 | Fries | 49/213 |
| 2002/0163284 | A1 | 11/2002 | Levy et al. | |
| 2004/0124191 | A1 | 7/2004 | Colladon | |
| 2004/0129732 | A1 | 7/2004 | Kutner | |
| 2005/0035697 | A1 | 2/2005 | Chen | |
| 2006/0186118 | A1 | 8/2006 | Stojak | |
| 2007/0084864 | A1 | 4/2007 | Thrush | |
| 2009/0115301 | A1 | 5/2009 | Cunsolo | |
| 2009/0302097 | A1 | 12/2009 | Vincent | |

* cited by examiner

*Primary Examiner* — Shawn M Braden

(74) *Attorney, Agent, or Firm* — Sheehan Phinney Bass + Green PA

(57) ABSTRACT

A portable storage enclosure is presented. The enclosure is a substantially rectangular enclosure formed of wood, having fixed ends and sides. The enclosure may have a back formed of slats held by grooves in the ends and/or sides. The enclosure has two sliding doors, each configured with an aperture, so that the apertures may be used both to manipulate the doors, and as handles to lift and transport the enclosure. The sliding doors have two closed positions, so that the apertures are oriented together at the center of the enclosure, or apart at the ends of the enclosure. The enclosure may also have handles on the ends and/or sides to facilitate carrying the enclosure in several orientations.

17 Claims, 8 Drawing Sheets

PORTABLE STORAGE ENCLOSURE WITH SLIDING DOORS

CROSS-REFERENCE TO RELATED APPLICATIONS

This application claims the benefit of U.S. Provisional Patent Application Ser. No. 61/473,028, filed Apr. 7, 2011, entitled "'Dove-Tail-Gate-Party-Box' is a completely biodegradable wooden storage box to house a cooler, briquettes, cutting board, etc," which is incorporated by reference herein in its entirety.

FIELD OF THE INVENTION

The present invention relates to a storage device, and in particular to a portable storage enclosure.

BACKGROUND OF THE INVENTION

People bring many items to a tail-gate party, including, but not limited to, food, beverages, and games. There are several devices used for transporting such items, such as plastic coolers, paper and cloth shopping bags, and wooden crates. However, some of these devices, such as plastic coolers, have negative environmental impacts, both in their production, and in their disposal. For example, plastic coolers are typically formed of petroleum products, requiring drilling and refining. Such plastics are typically not biodegradable. Cloth and paper bags and picnic baskets may not be sturdy enough to transport heavier items. While wooden crates may be more stable and sturdy than bags and baskets, they may also be more difficult to open and close, and may also be unwieldy to transport.

Besides practical concerns, the abovementioned solutions are not particularly visually appealing. Tailgating is taken very seriously by many people who may wish to provide a more upscale atmosphere than created by plastic coolers, crates and shopping bags. There is therefore an unmet need in the industry to address the abovementioned shortcomings.

SUMMARY OF THE INVENTION

Embodiments of the present invention provide a portable storage enclosure with sliding doors. Briefly described in architecture, a first aspect the present invention is directed to a portable storage enclosure, having a substantially rectangular frame. The frame includes a first end disposed opposite a second end, and a first side attached to the first end and the second end. The first side is disposed opposite a second side attached to the first end and the second end. The portable storage enclosure includes a back attached to the frame, and a door. The door includes a front sliding door slideably disposed against the first side and the second side, and a rear sliding door substantially adjacent to the front sliding door slideably disposed against the first side and the second side. The portable storage enclosure further includes a master handle configured for lifting the portable storage enclosure, having a front door aperture in the front sliding door and a rear door aperture in the rear sliding door.

The master handle may further include a first position wherein the front door aperture and the rear door aperture are substantially adjacent, and a second position, wherein the front door aperture and the rear door aperture are at substantially opposite ends of the portable enclosure. The master handle may further include a first end aperture in the first end and a second end aperture in the second end, wherein in the second position the first end aperture and the front aperture together form a first end handle, and the second end aperture and the rear aperture together form a second end handle. The front door aperture, the rear door aperture, the first end aperture and the second end aperture may include at least one of a thumb hole, a finger hole, and a hand grip.

The first end and the second end may bound the sliding range of the front sliding door and the rear sliding door. The portable storage enclosure may also include a baffle disposed between the first side and the second side. The portable storage enclosure may be formed substantially of wood, and may include a secondary front door handle and a secondary rear door handle.

A second aspect of the present invention is directed to a method for manufacturing a portable storage enclosure. The method includes the steps of forming an enclosure having two end pieces, two side pieces and a back, forming slider tracks on the side pieces, forming a front sliding door including a front door aperture and a rear sliding door having a rear door aperture, and inserting the front sliding door and the rear sliding door into the slider tracks.

The method may further include the steps of forming the end pieces, forming the side pieces, forming the back, attaching the side pieces to the end pieces, and attaching the back to the side pieces and the end pieces. Additional steps may include the steps of forming baffle grooves in the side pieces, forming a baffle, and inserting the baffle into the grooves. Further steps may include forming back grooves into the side pieces, forming a first tongue and a second tongue on the back, inserting the first tongue, and the second tongue into the back grooves.

Briefly described in architecture, a third aspect the present invention is directed to a portable storage enclosure, including a frame having a first end disposed opposite a second end, a first side attached to the first end and the second end, disposed opposite a second side attached to the first end and the second end, a front track disposed on the first side and the second side, and a rear track disposed in back of the front track on the first side and the second side, wherein the rear track is substantially adjacent the front track. The enclosure also includes a back attached to the frame, a front sliding door slideably disposed within in the front track, further having a primary front door handle disposed at a first end of the front sliding door and a secondary front door handle disposed at a second end of the front sliding door, and a rear sliding door slideably disposed within the rear track, further having a primary rear door handle disposed at a first end of the rear sliding door and a secondary rear door handle disposed at a second end of the second sliding door. The front sliding door and the rear sliding door form a first closed position where the primary front handle is substantially adjacent to the primary rear handle, and the front sliding door and the rear sliding door form a second closed position where the secondary front handle is substantially adjacent to the secondary rear handle.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1:
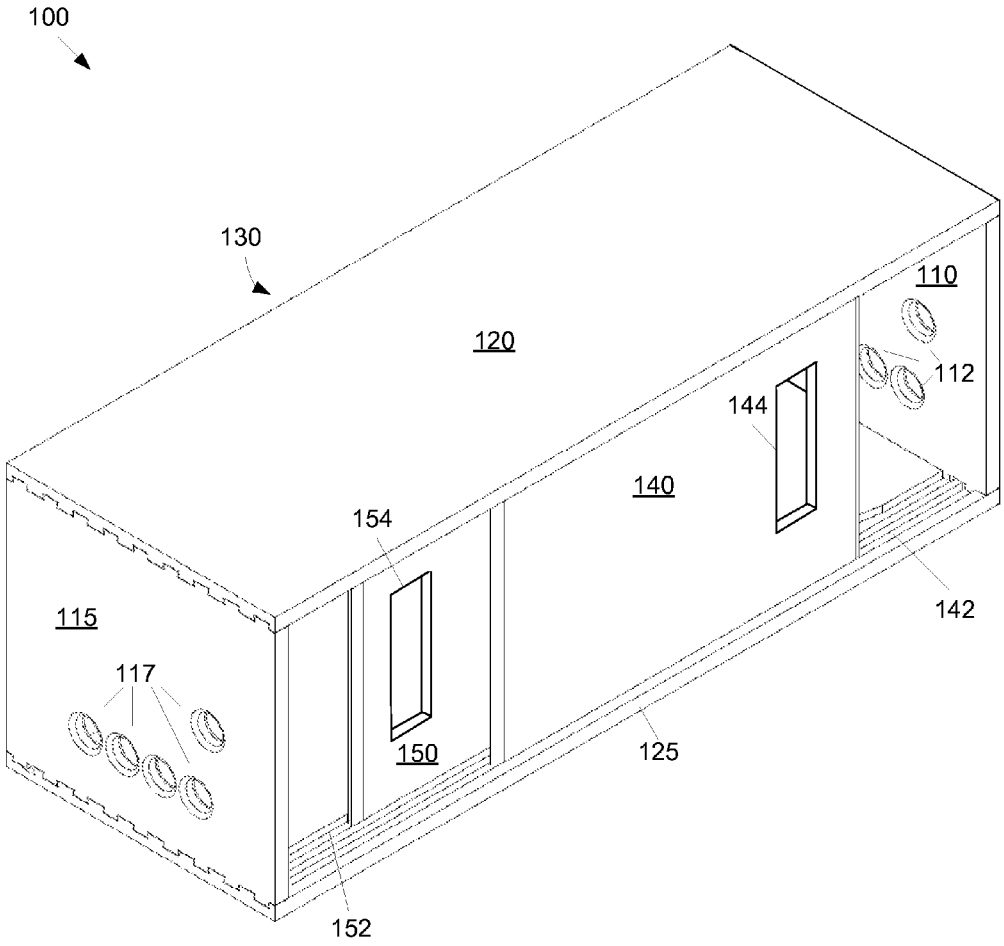
FIG. 1 is a schematic diagram of a first exemplary embodiment of a portable storage enclosure.

Reference will now be made in detail to embodiments of the present invention, examples of which are illustrated in the accompanying drawings. Wherever possible, the same reference numbers are used in the drawings and the description to refer to the same or like parts.

In general, an exemplary embodiment of the portable storage enclosure is a substantially rectangular enclosure formed of wood, having fixed ends and sides. The enclosure may have a back formed of slats held by grooves in the ends and/or sides. The enclosure has two substantially adjacent sliding doors, each configured with an aperture, so that the apertures may be used both to manipulate the doors, and as handles to lift and transport the enclosure. The sliding doors have two closed positions, so that the apertures are oriented together at the center of the enclosure, or apart at the ends of the enclosure. The enclosure may also have handles on the ends and/or sides to facilitate carrying the enclosure in several orientations.

FIG. 1 is a schematic diagram of a first exemplary embodiment of a portable storage enclosure 100. The enclosure 100 may be substantially rectangular in shape. A frame is formed of a first side 120 and a second side 125, bounded by a first end 110 substantially opposite a second end 115. The frame has a back edge bounded by a back 130. The frame and the back form a substantially fixed structure for the enclosure 100. The interior of the enclosure 100 may be accessed by a front sliding door 140 and a rear sliding door 150. The front sliding door 140 slides in a front track track 142 on the sides 120, 125, and the rear sliding door 150 slides in a rear track 152 on the sides 120, 125. The front track 142 may be substantially adjacent to the rear track 152. The tracks 142, 152 may be grooves formed into the surfaces of the sides 120, 125, as shown in the first embodiment. In alternative embodiments, the tracks 142, 152 may be rails raised above the surfaces of the sides 120, 125, or the tracks 142, 152 may be formed as a combination of rails and grooves on the sides 120, 125.

The front track 142 and the rear track 152 each span between the first end 110 and the second end 115. The range of motion of the sliding doors 140, 150 is bounded by the first end 110 and the second end 115, so that the ends 110, 150 block the ends of the tracks 142, 152. This arrangement confines the sliding doors 140, 150 within the tracks, and provides sufficient structure so that the enclosure 100 may be lifted by the doors 140, 150, as described in greater detail below. The front sliding door 140 may slide along the entire range of the front track 142, so the front sliding door 140 may abut the first end 110, or the front sliding door 140 may abut the second end 115. Likewise, the rear sliding door 150 may slide along the entire range of the rear track 152, so the rear sliding door 150 may abut the first end 110, or the rear sliding door 150 may abut the second end 115. The sliding doors 140, 150 may be further secured by end tracks (not shown) substantially parallel to the front track 142 and rear track 152 formed in the ends 110, 115.

Transporting of the enclosure 100 may be facilitated by several handles or apertures. The front sliding door 140 has a front door aperture 144 located at one end of the front door 140. Similarly, the rear sliding door 150 has a rear door aperture 154 located at one end of the rear door 150. The first end 110 has a first end aperture 112 located near the sliding door opening at the first end 110, and the second end 115 has a second end aperture 117 located near the sliding door opening at the second end 115. In the first embodiment, the end apertures 112, 117 may be implemented as two or more hand and finger/thumb holes. Other configurations for the first end aperture 112 and second end aperture 117 are described below.

Figure 2A:
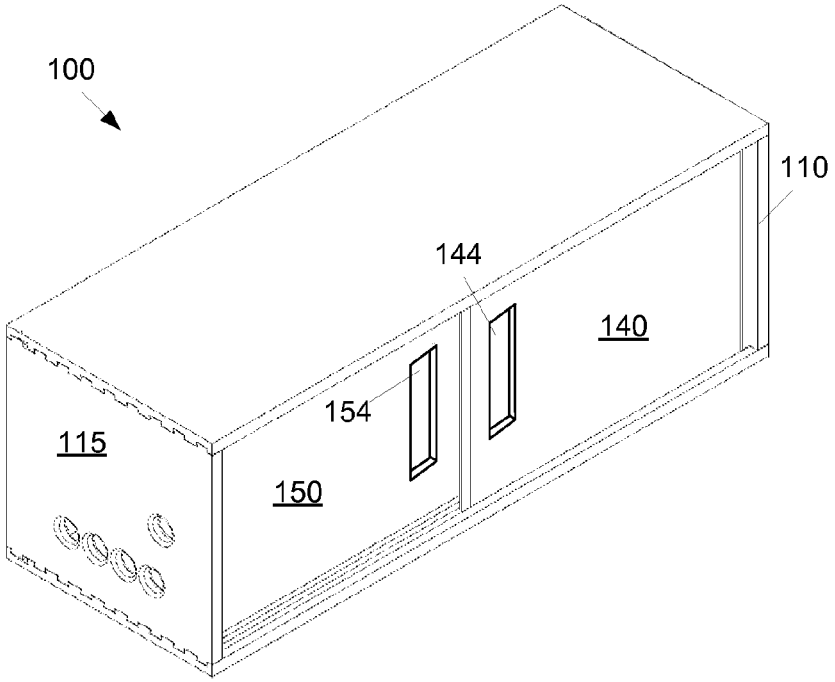
FIG. 2A is a schematic diagram of the portable storage enclosure with the sliding doors in a first closed position.
Figure 2B:
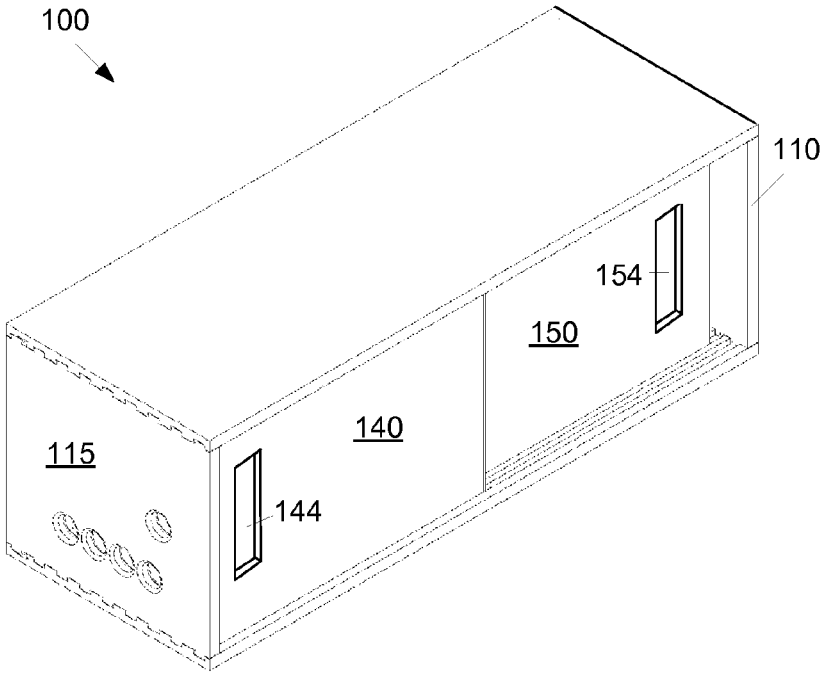
FIG. 2B is a schematic diagram of the portable storage enclosure with the sliding doors in a second closed position.

The front sliding door 140 and the rear sliding door 150 are sized so that the enclosure 100 may be substantially closed in when the sliding doors 140, 150 are in each of two positions. In the first closed position as shown by FIG. 2A, the front sliding door 140 abuts the first end 110, and the rear sliding door 150 abuts the second end 115. In the second closed position, as shown by FIG. 2B, the front sliding door 140 abuts the second end 115, and the rear sliding door 150 abuts the first end 110. It should be noted there is no objection to having the front sliding door 140 abutting the second end 115 and the rear sliding door 150 abutting the first end 110 in the first closed position, and the front sliding door 150 abutting the first end 110 and the rear sliding door abutting the second end 115 in the second closed position.

In the second closed position, the front door aperture 144 and the rear door aperture 154 are substantially opposite to one another near the ends 110, 115 of the enclosure 100. In the second closed position, the enclosure 100 may be lifted by the door apertures 144, 154 as positioned near the ends 110, 115 of the enclosure 100. The second position may be convenient for two persons transporting the enclosure, for example, a first person lifting the enclosure by the front aperture 144, and a second person lifting the enclosure by the rear aperture 154. Such a carrying position may be facilitated by the carrier holding the enclosure 100 by simultaneously gripping the enclosure 100 through one of the door apertures 144, 154 and one of the end apertures 112, 117 with one hand.

Returning to FIG. 2A, in the first closed position, the front door aperture 144 and the rear door aperture 154 are substantially adjacent to one another near the center of the enclosure 100. In the first closed position, the enclosure 100 may be lifted and carried by the carrier simultaneously gripping the door apertures 144, 154 with one hand.

The front sliding door 140 and the rear sliding door 150 may be substantially the same size. However, there is no objection to the front door 140 being shorter than the rear door 150, with respect to the length of the tracks 142, 152. This may be advantageous, for example, in configurations where the center of gravity of the enclosure 100 is off center, so the sliding doors may be configured such that the front handle 144 and the rear handle 154 meet substantially above the balance point of the enclosure 100.

It should be noted that while FIG. 1 shows the enclosure 100 oriented so the doors 140, 150 open at the side of the enclosure 100, there is no objection to the enclosure 100 being oriented such that the doors 140, 150 open at the top of the enclosure, so that the back 130 serves as the bottom of the enclosure 100.

The back 130 may be substantially one piece fixed in place, or the back 130 may be formed of multiple pieces or slats held loosely in place by the sides 120, 125 and ends 110, 115. It may be advantageous for the back 130 to be formed of loosely held slats that move, for example by tongues at the ends of the slats held in place by grooves in the sides 120, 125, so that the slats can move somewhat and allow movable gaps that may facilitate cleaning or drainage of fluids spilled inside the enclosure 100.

Baffles

Figure 3:
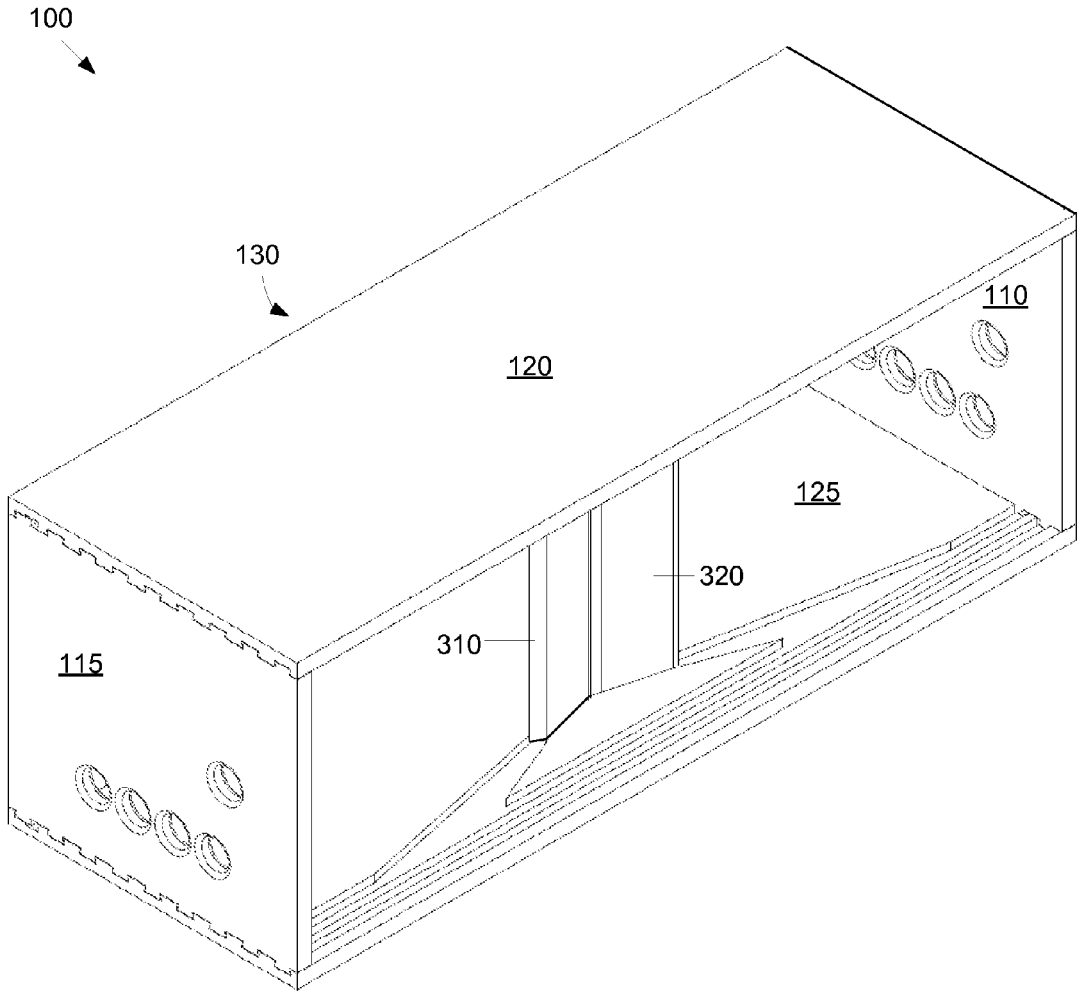
FIG. 3 is a schematic diagram of the portable storage enclosure shown without the sliding doors.

When the sliding doors 140, 150 are in the first closed position (FIG. 2A), the sliding door apertures 144, 154 provide exposure to the contents of the enclosure 100. FIG. 3 is a schematic diagram of the enclosure 100 without the sliding doors 140, 150 to provide a view of the interior of the enclosure 100. A first baffle 310 and a second baffle 320 may be positioned inside the enclosure 100 behind the sliding door apertures 144, 154 (FIG. 2A). The baffles 310, 320 may be oriented at an angle with respect to one another to provide hand access through the door apertures 144, 154 (FIG. 2A) and still provide covering for the contents of the enclosure 100. For example, dirt or debris falling through the sliding door apertures 144, 154 (FIG. 2A) that might otherwise fall onto the contents of the enclosure 100 may instead fall upon the baffles 310, 320.

Figure 4:
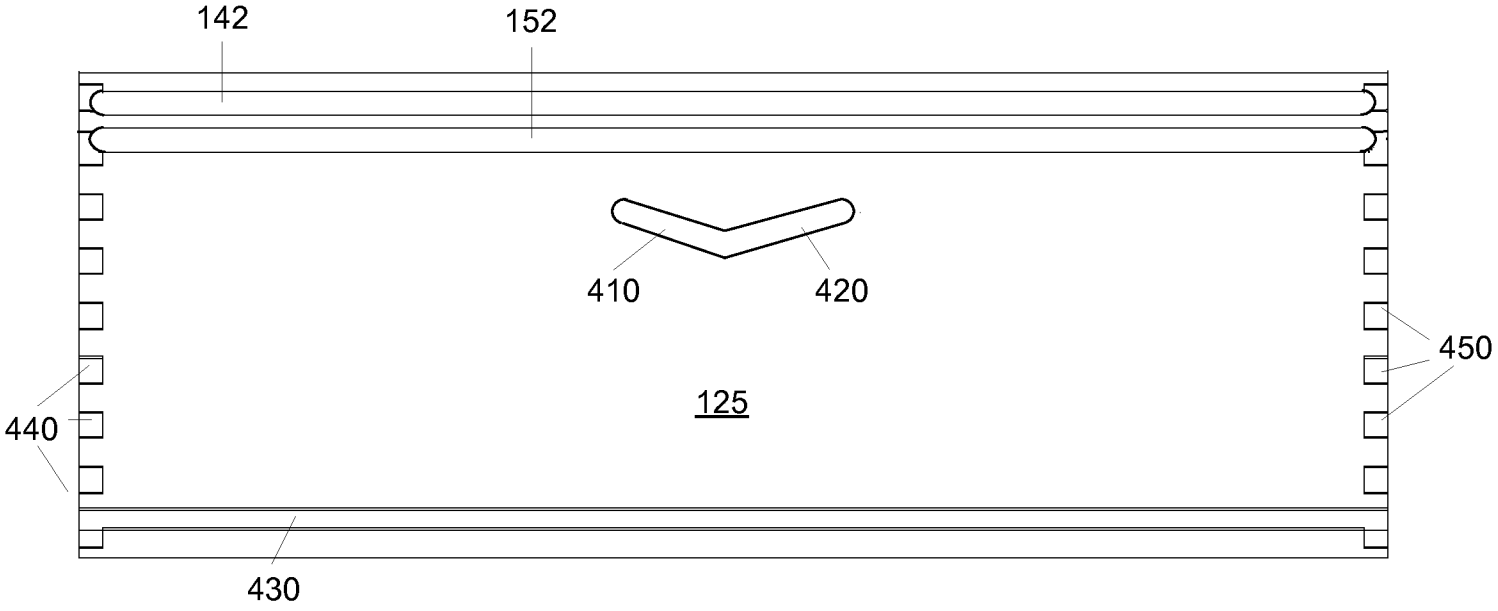
FIG. 4 is a schematic diagram detailing one side of the portable storage enclosure.

As shown by FIG. 4, the baffles 310, 320 may be secured to the second side 125 by locating the baffles 310, 320 into grooves 410, 420, and similar grooves (not shown) in the opposite side 120 (not shown). FIG. 4 also shows a back groove 430 that may be used to secure the back 130 (not shown), as well as the front sliding track 142 configured to secure and guide the front sliding door 140 (FIG. 1) and the rear sliding track 152, likewise configured to secure and guide the rear sliding door 150 (FIG. 1). Under the first embodiment, the second side 125 may also have a first end dovetail region 440 and a second end dovetail region 450 used to secure the second side 125 to the first end 110 (FIG. 1) and the second end 115 (FIG. 1). Of course, the first side 120 (FIG. 1) is similarly configured to the second side 125. It should be noted that the baffle grooves 410, 420 may be extended beyond the length of the baffles 310, 320, as shown in FIG. 3.

Carrying Positions

The carrying positions mentioned above describe the sliding doors being oriented at the top of the enclosure 100. The enclosure may be configured to provide convenient handling in other orientations as well.

Figure 5A:
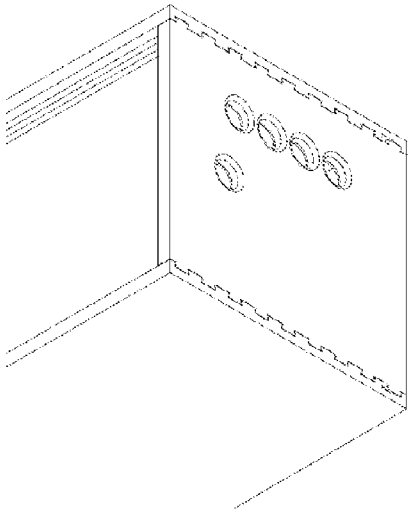
FIG. 5A-5D are schematic diagrams detailing aperture configurations at one end of the portable storage enclosure.

When the enclosure is oriented so the sliding doors 140, 150 are on one side of the enclosure 100, it may be convenient to carry the enclosure 100 by the end apertures 112, 117. In particular, alternative embodiments of an enclosure shown in FIGS. 5A-5D may further facilitate carrying the enclosure 100 in a side opening orientation. In a preferred embodiment, shown by FIG. 5A, the end apertures 112, 117 in the ends 110, 115 are configured with finger and thumb holes. Such a configuration provides access to carrying the enclosure 100 from the end handles 112, 117 when the enclosure 100 is oriented horizontally with the sliding doors 140, 150 opening to the top or the side, as well as when the enclosure 100 is vertically oriented, so one end is located at the top of the enclosure 100 and the other end is located at the bottom of the enclosure. The finger and thumb holes may be oversized, for example, to accommodate large and/or gloved hands.

Figure 5B:
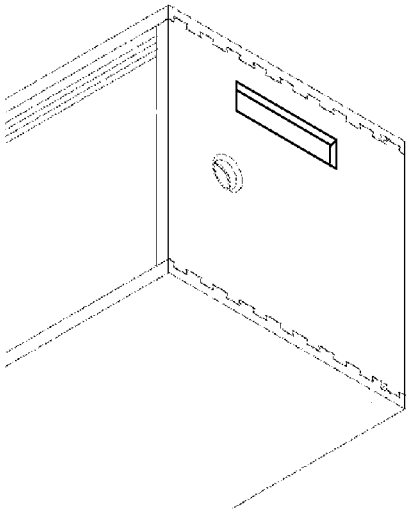
Figure 5C:
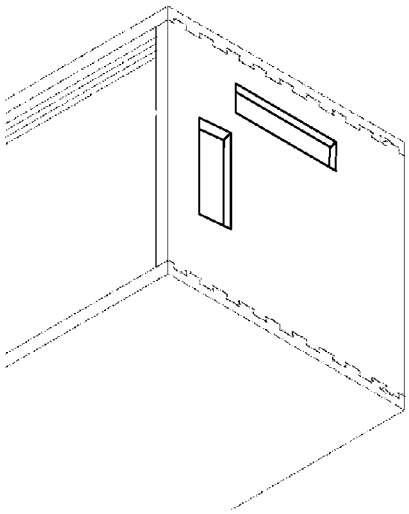
Figure 5D:
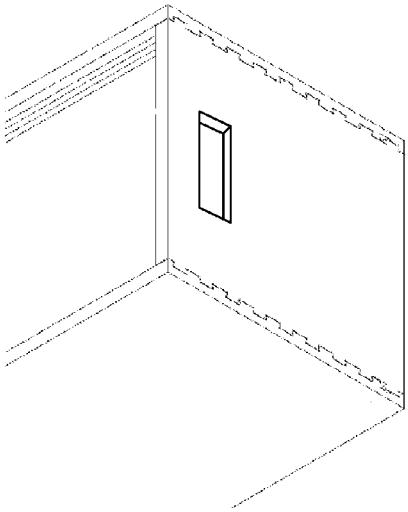

In an alternative embodiment, shown by FIG. 5B, the end apertures 112, 117 in the ends 110, 115 are configured with a slot aperture, for example, for fingers, and a thumb hole. In another embodiment, as shown by FIG. 5C, two slot shaped apertures are provided, one oriented along the side, and another oriented adjacent to the sliding doors 140, 150 (not shown). The edges of the slots may be smooth, or may be ridged to accommodate fingers gripping the enclosure 100. Similarly, the corners of the handles may be rounded rather than rectangular. An additional embodiment, shown by FIG. 5D has a single slot aperture along the door opening edge of the ends 110, 115. Of course, other handle orientations are possible.

In an alternative embodiment, the enclosure 100 does not have the end apertures 112, 117 in the ends 110, 115, but rather other types of handles, for example, protruding wooden handles, a handle formed by indentations in the ends 110, 115 that do not pass entirely through the ends 110, 115. Of course, other types of end handles 112, 117 incorporating some or all of protrusions, indentations, and/or apertures familiar to persons having ordinary skill in the art are possible, and are within the scope of this disclosure. Similarly, the enclosure may have additional handles on the enclosure sides, for example, recesses, apertures, and/or protruding handles affixed to the sides of the enclosure.

As noted above, it may be convenient to transport the enclosure 100 in a vertical carrying position. For example, it may be easier to maneuver the enclosure 100 in crowded spaces when the enclosure 100 is in a vertical position. In this scenario, the sliding doors may be secured by tying them together with a string or twine through the door apertures 144, 154 when the doors are in the first closed position. Similarly, the topmost sliding door may be secured by fastening the sliding door to the topmost end, for example, with a string or twine tied through the door aperture 144, 154 and the end apertures 112, 117. Of course, other means familiar to persons having ordinary skill in the art may be used to fasten the sliding doors shut, such as latches, hooks and other fasteners.

The enclosure may be fitted with feet (not shown) to raise the flat surfaces of the enclosure off of the ground or floor. The feet may be, for example, wooden pegs inset into the back, sides and/or ends of the enclosure, so the enclosure may be set down on its back, sides and/or ends without scratching or marring the flat surfaces.

Second Embodiment

Figure 6:
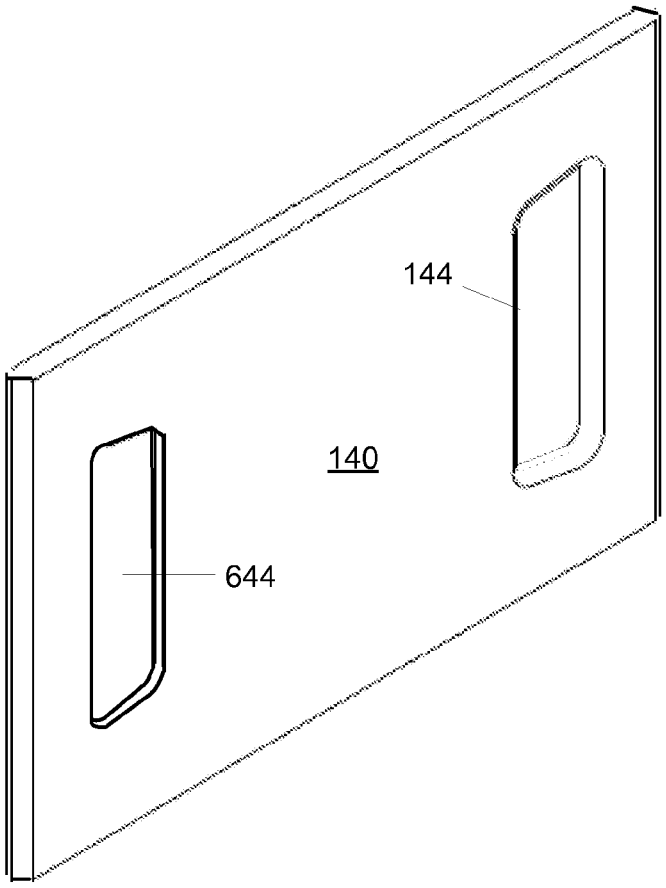
FIG. 6 is a schematic diagram of a sliding door of an exemplary embodiment of a portable storage enclosure.

In a second embodiment, as shown in FIG. 6, the front sliding door 140 may be configured with a sliding door recess 644 in addition to the front door aperture 144. The front door recess 644 is inset into the front sliding door 140, but does not pass all the way through the front sliding door 140. The front door recess 644 provides an additional means for opening and closing the front sliding door 140, but without exposing the contents of the interior of the enclosure 100 (FIG. 1). Under the second embodiment, the rear sliding door 150 (not shown) may be similarly configured with a rear door recess (not shown) that is substantially similar to the front door recess 644.

Method

Figure 7:
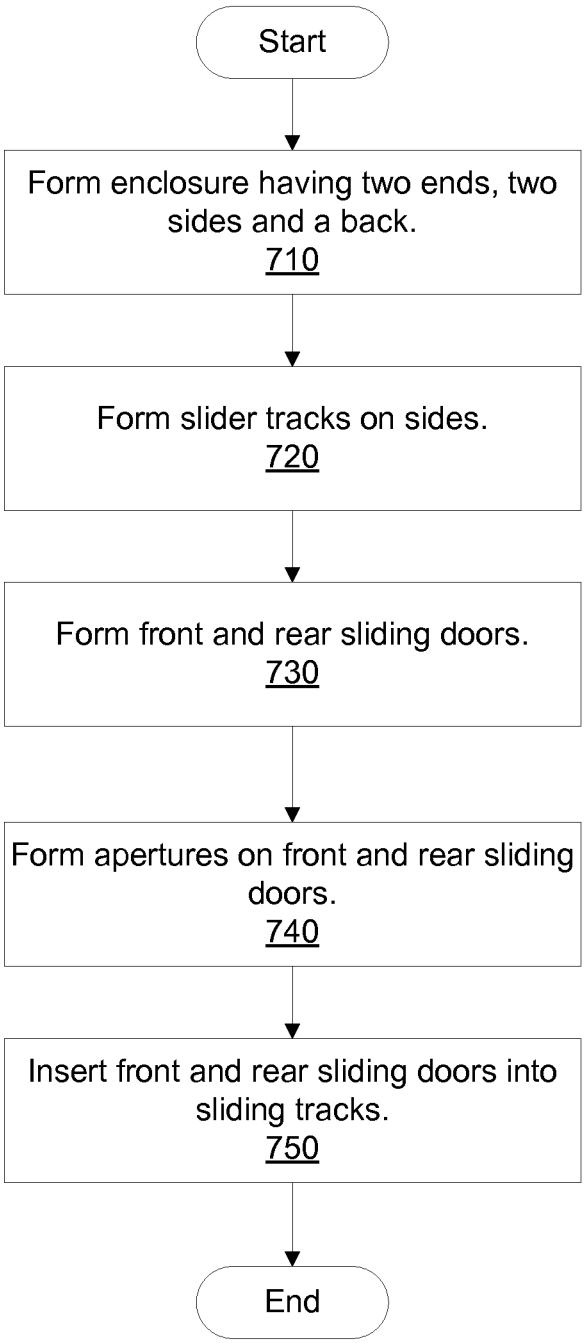
FIG. 7 is a flowchart of an exemplary method for making a portable storage enclosure.

FIG. 7 is a flowchart of an exemplary method for making a portable storage enclosure. It should be noted that any process descriptions or blocks in flow charts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

Figure 8:
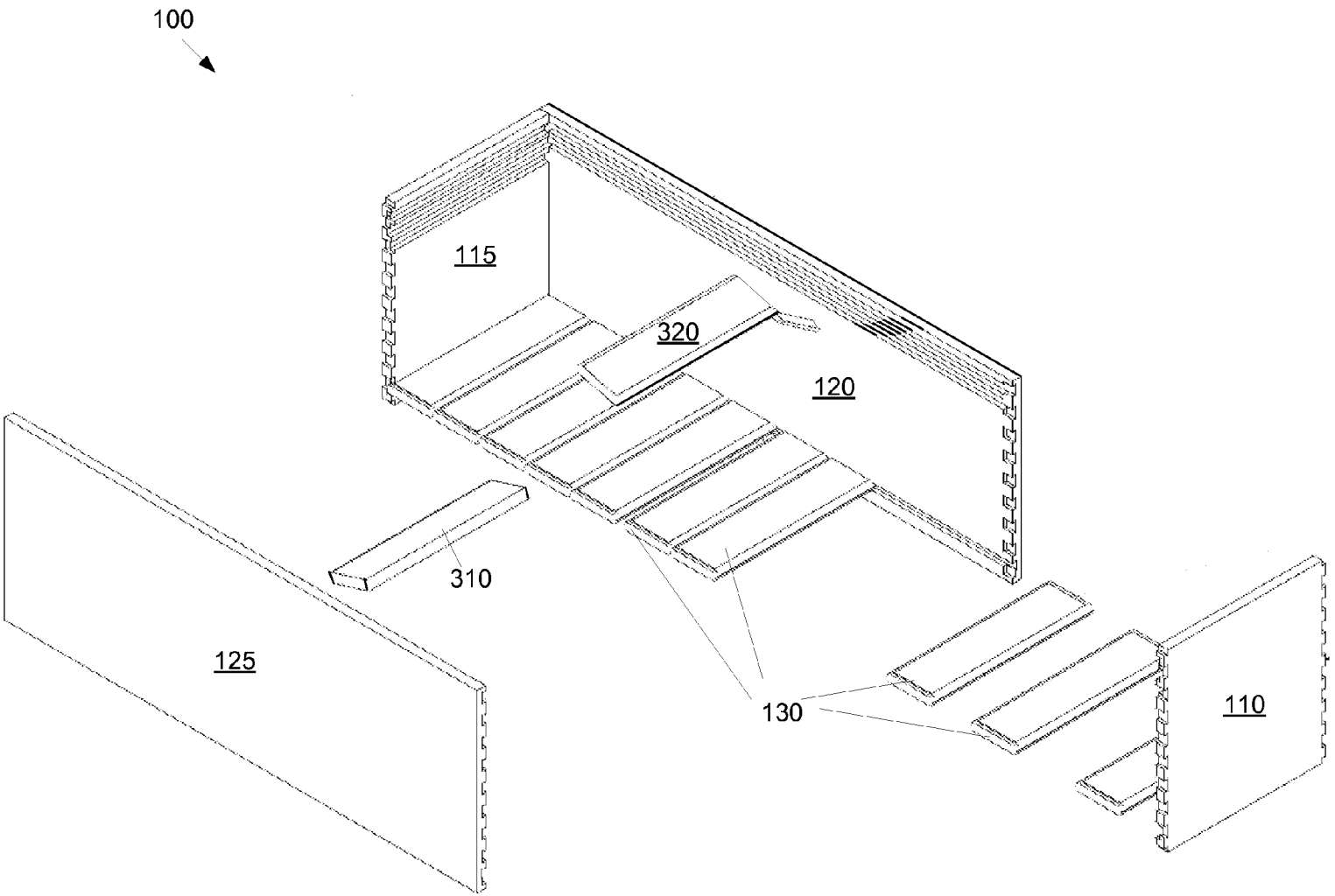
FIG. 8 is a schematic diagram of an embodiment of the portable storage enclosure in exploded form, without sliding doors.

As shown by block 710, an enclosure is formed having two ends, two sides and a back. Slider tracks are formed on the sides, as shown by block 720. As noted above, the slider tracks may be formed as grooves or slots within the sides. Front and rear sliding doors are formed, as shown by block 730. Apertures are formed in the front and rear doors, as shown by block 740. The front and rear sliding doors may function as door handles, as well as handles to lift and transport the entire enclosure. The front and rear sliding doors are inserted into the slider tracks, as shown by step 750. The front and rear sliding doors may be inserted at the time the sides and ends are being assembled. FIG. 8 shows an exploded view of the enclosure, sans sliding doors, according to the exemplary method.

The enclosure 100 may formed of natural materials, such as solid wood or wood composites. However, there is no objection to forming the enclosure from other materials, such as plastics. Examples of solid woods used to construct the enclosure may include pine, oak, maple, cherry, birch, or walnut, among others. Plywood, composite woods, and/or reclaimed woods may also be used.

The enclosure 100 may be constructed using techniques that do not require hardware. For example, the sides 120, 125 may be joined to the ends 110, 115 with dovetail joints, mortise and tenon, dowel, or other joining methods. Such constructions methods may be advantageous by reducing the environmental footprint for both manufacturing and, eventually, disposing of the enclosure 100.

The enclosure may be finished with, for example, stain, lacquer, clear coats, mineral oils, solid paints, and other finishes. In a preferred embodiment the finish is non-irritating, food safe, and bio-friendly.

Accessories

The enclosure 100 may be configured to accommodate several types of accessories. Examples of such accessories include, but are not limited to, a center divider, a cutting board and trays. The enclosure may include slots or grooves to support the accessories. For example, the cutting board may slide into place next to the center divider, and the trays may be sized to hold the cutting board in position. Alternatively, the cutting board may be held in place with a cutting board support. Other accessories may include a small cooler and wooden briquettes.

The type, grade and figure of the wood may be determined by a purchaser of the enclosure. The sides and/or ends may be painted, stained, or engraved with, for example, signs, pictures, logos, or other symbols.

In summary, exemplary embodiments of a portable storage enclosure have been presented. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A portable storage enclosure, comprising:

a substantially rectangular frame comprising:

a first end disposed opposite a second end; and a first side attached to said first end and said second end disposed opposite a second side attached to said first end and said second end;

a front sliding door groove formed in said first side and said second side;

a rear sliding door groove formed in said first side and said second side;

a back attached to said frame;

a door comprising:

a front sliding door slideably disposed within the front sliding door groove against said first side and said second side; and a rear sliding door substantially adjacent to said front sliding door slideably disposed within the rear sliding door groove against said first side and said second side;

a master handle configured for lifting said portable storage enclosure, comprising a front door aperture in said front sliding door, a rear door aperture in said rear sliding door, and a first closed door master handle position wherein said front door aperture and said rear door aperture are substantially adjacent; and a baffle attached to said first side and said second side, said baffle disposed between said back and said door at a first distance above said back and a second distance below said door when said back is oriented as a floor of said enclosure, said first distance being larger than said second distance, and said second distance defining a gap between said baffle and said door, wherein said front sliding door is configured to slide within said front groove between said first end and said second end, said rear sliding door is configured to slide within said rear groove between said first end and said second end, said baffle is disposed inside said portable storage enclosure behind said front door aperture and/or said rear door aperture and said gap is configured to provide hand access through the door apertures within said gap and said baffle is oriented to provide covering for contents of said portable storage enclosure beneath said master handle in said first closed door master handle position.

2. The portable storage enclosure of claim 1, wherein said master handle further comprises:

a second closed door master handle position, wherein said front door aperture and said rear door aperture are at substantially opposite ends of said portable enclosure.

3. The portable storage enclosure of claim 2, wherein said master handle further comprises a first end aperture in said first end and a second end aperture in said second end, wherein in said second closed door master handle position said first end aperture and said front aperture together form a first end handle, and said second end aperture and said rear aperture together form a second end handle.

4. The portable storage enclosure of claim 3, wherein each of said front door aperture, said rear door aperture, said first end aperture and said second end aperture comprise at least one of the group consisting of a thumb hole, a finger hole, and a hand grip.

5. The portable storage enclosure of claim 1, wherein said first end and said second end bound the sliding range of said front sliding door and said rear sliding door.

6. The portable storage enclosure of claim 1 wherein said portable storage enclosure is formed substantially of wood.

7. The portable storage enclosure of claim 1 further comprising a secondary front door handle and a secondary rear door handle.

8. The portable storage enclosure of claim 7, wherein:

said secondary front handle comprises an indentation in said front sliding door; and said secondary rear handle comprises an indentation in said rear sliding door.

9. The portable storage enclosure of claim 1, wherein said first side attachments to said first end and said second end and said second side attachments to said first end and said second end comprise dovetail joints.

10. The portable storage enclosure of claim 1, wherein:

said front track comprises a front groove in said first side and said second side; and said rear track comprises a rear groove in said first side and said second side.

11. A method for manufacturing a portable storage enclosure, comprising the steps of:

forming an enclosure comprising two end pieces, two side pieces and a back;

forming slider tracks on said side pieces;

forming a front sliding door comprising a front door aperture and a rear sliding door comprising a rear door aperture;

forming baffle grooves in said side pieces, said baffle grooves disposed between said back and said slider tracks at a first distance above said back and a second distance below said slider tracks when said back is oriented as a floor of said enclosure, said first distance being larger than said second distance, and said second distance defining a gap between said baffle grooves and said slider tracks;

forming a baffle;

inserting said baffle into said grooves; and inserting said front sliding door and said rear sliding door into said slider tracks, wherein said baffle grooves are formed in a location to position said baffle behind said front door aperture and/or said rear door aperture, said gap is configured to provide hand access through the door apertures within said gap and said baffle groove is oriented to position the baffle to provide covering for contents of said portable storage enclosure beneath said master handle in a first closed door master handle position wherein said front door aperture and said rear door aperture are substantially adjacent.

12. The method of claim 11, further comprising the steps of:

forming said end pieces;

forming said side pieces;

forming said back;

attaching said side pieces to said end pieces; and attaching said back to said side pieces and said end pieces.

13. The method of claim 11, further comprising the step of forming an end aperture into said first end piece.

14. The method of claim 11, further comprising the step of forming an end aperture into said second end piece.

15. The method of claim 11, further comprising the step of forming a recess handle on said front sliding door.

16. The method of claim 11, further comprising the step of forming a recess handle on said rear sliding door.

17. The method of claim 11, further comprising the steps of:

forming back grooves into said side pieces;

forming a first tongue and a second tongue on said back; and inserting said first tongue and said second tongue into said back grooves.

* * * * *